United States Patent [19]

Clark, Jr.

[11] 4,100,859

[45] Jul. 18, 1978

[54] FORK LIFT PALLET

[76] Inventor: Alexander B. Clark, Jr., Box 2012, Hendersonville, N.C. 28739

[21] Appl. No.: 720,963

[22] Filed: Sep. 7, 1976

[51] Int. Cl.[2] ..... B65D 19/34

[52] U.S. Cl. ..... 108/51.3; 108/57.1; 206/600

[58] Field of Search ..... 108/51.1, 51.3, 56.1, 108/57.1; 206/386, 600; 229/32, 37 E, 49

[56] References Cited

U.S. PATENT DOCUMENTS

| | | | |
|---|---|---|---|
| 2,885,137 | 5/1959 | Guyer | 229/32 X |
| 2,996,276 | 8/1961 | Sorensen et al. | 108/51.3 |
| 3,207,414 | 9/1965 | Locke et al. | 229/49 X |
| 3,302,593 | 2/1967 | Roberts | 108/51.3 |
| 3,659,534 | 5/1972 | Childs | 108/51.3 |
| 3,666,165 | 5/1972 | Osborne et al. | 108/51.3 X |
| 3,911,834 | 10/1975 | Quaintance | 108/57.1 X |

FOREIGN PATENT DOCUMENTS

| | | | |
|---|---|---|---|
| 1,289,970 | 9/1972 | United Kingdom | 229/32 |

*Primary Examiner*—James T. McCall
*Assistant Examiner*—William E. Lyddane
*Attorney, Agent, or Firm*—Bailey, Dority & Flint

[57] ABSTRACT

A disposable fork lift pallet is illustrated wherein substantially rectangular insert means utilizing vertical tubular supports at each corner thereof offering vertical and horizontal support are utilized at each of the four corners of the pallet.

6 Claims, 19 Drawing Figures

Fig. 16.
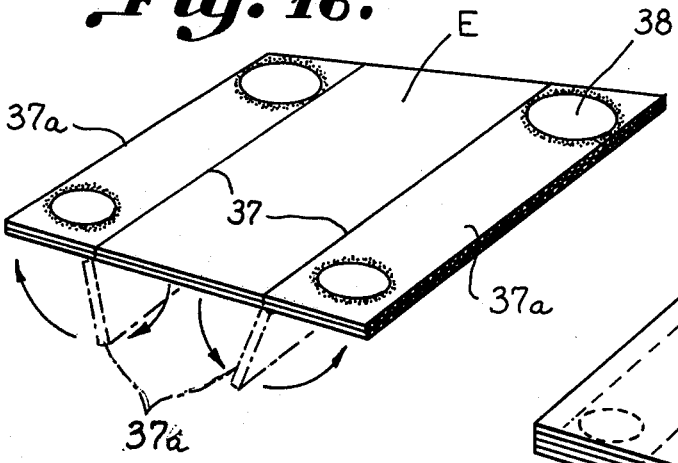
Fig. 15.
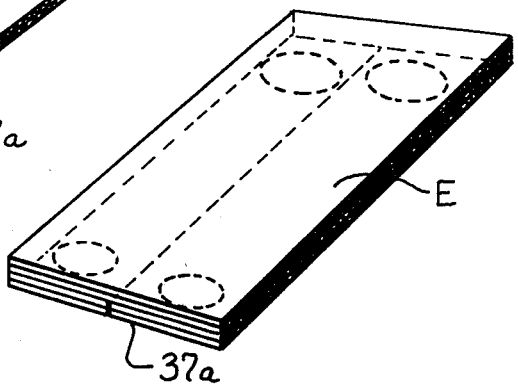
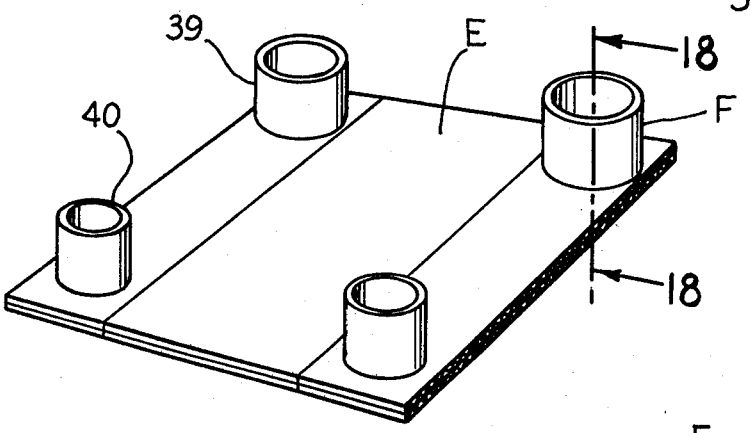
Fig. 17.
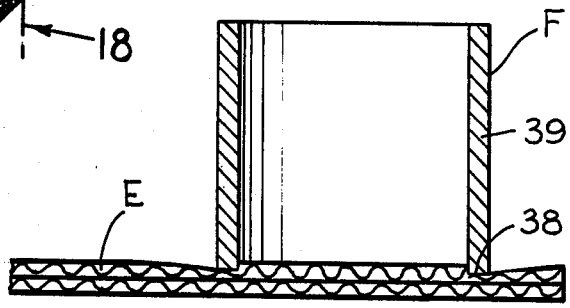
Fig. 18.
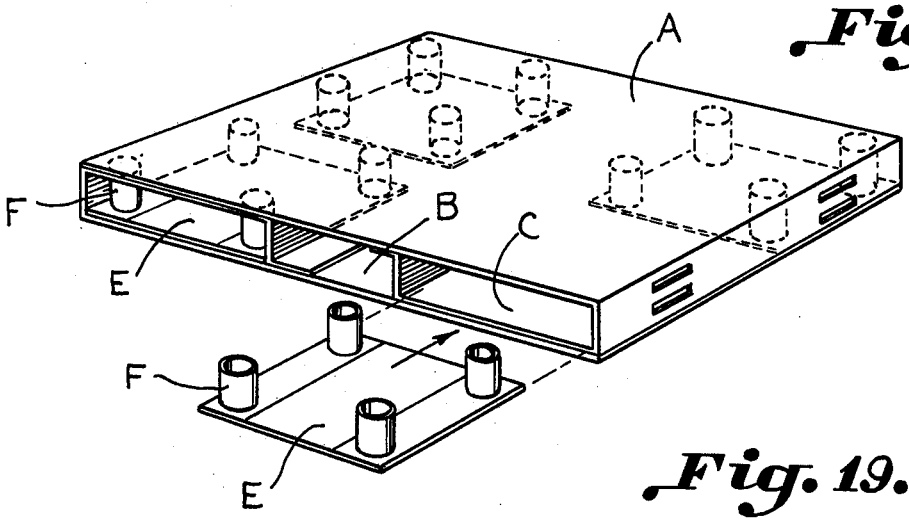
Fig. 19.

FORK LIFT PALLET

This invention relates to expendable cardboard pallets utilizing a support means in the form of an insert at each corner of the pallet, wherein each insert means comprises a plurality of spaced tubular supports, and wherein the pallet and insert means therefor may be foldable.

BACKGROUND OF THE INVENTION

Pallets constructed of cardboard and the like have been limited as to the size and weight of load which can be carried thereby. Many efforts have been made to increase the size of the pallet which may be constructed of cardboard in such a way as to maximize the effectiveness of the material utilized so as to reduce the cost of expendable pallets. For example, U.S. Letters Pat. No. 3,626,860 illustrates the use of cardboard pallets having spaced aligned runners which are reinforced through the use of frangible material. U.S. Letters Pat. No. 3,659,534 illustrates a fork lift pallet having superposed blanks which are formed at opposite ends to provide tubular aligned supports with intermediate tubular supports being interposed at right angles between the first mentioned tubular supports. U.S. Letters Pat. No. 3,911,834 illustrates the use of a pallet which is formed from a single sheet into longitudinal runners which are provided with spaced intermediate cardboard supports.

It is an important object of this invention to construct a pallet more efficiently utilizing cardboard construction material while permitting increased loads to be carried by the pallets.

Another important object of the invention is to provide a pallet which may be shipped with the cardboard flat and then assembled economically with a minimum of time and labor involved.

Another important object of the invention is to provide a four-way pallet accommodating a fork lift in such a manner as to make economic use of material while reducing labor requirements in assembly.

Another important object of the invention is to provide a disposable pallet which may be inexpensively shipped and assembled in such a way as to derive maximum benefit from the material from which it is constructed.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 15 is a perspective view illustrating an insert constructed in accordance with a modified form of the invention, FIG. 16 is a perspective view further illustrating the modified form of the invention wherein the rectangular insert means are folded into open position, FIG. 17 is a perspective view illustrating a subsequent step in the assembly of the rectangular insert means of FIGS. 15 and 16, FIG. 18 is a transverse sectional elevation taken on the line 18—18 in FIG. 17, and FIG. 19 is a perspective view illustrating an assembled pallet in accordance with the modified form of the invention illustrated in FIGS. 15–18.

DESCRIPTION OF A PREFERRED EMBODIMENT

Figure 1:
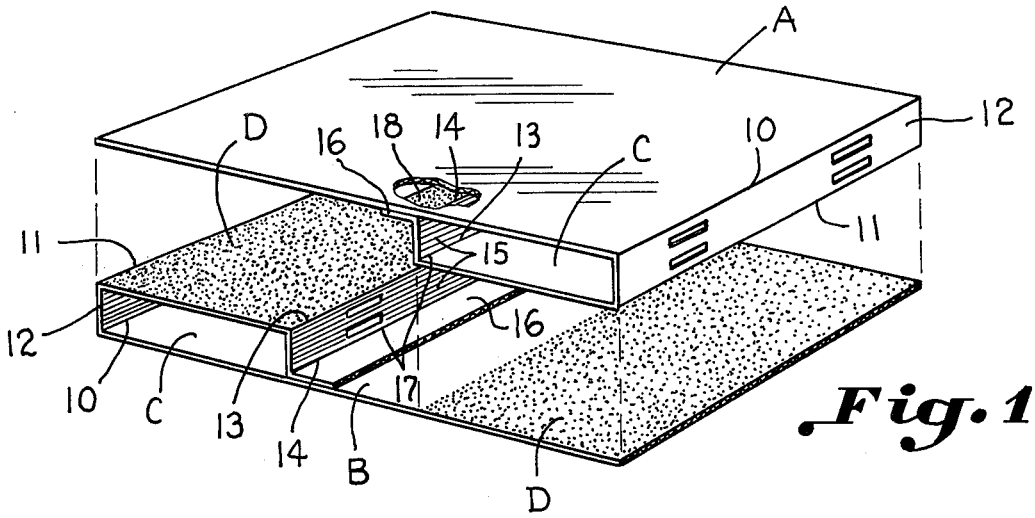
FIG. 1 is a perspective view illustrating a pair of opposed blanks from which a pallet constructed in accordance with the present invention may be assembled in the initial stages of assembly.

The drawings illustrate a foldable fork lift pallet having a pair of opposed substantially rectangular superposed blanks A and B. A plurality of spaced transverse scores are placed in each of the blanks defining fold lines for forming an elongated transverse inwardly facing spaced compartment C of substantially rectangular cross-section adjacent an opposite end of each of the blanks. Suitable means for securing each of the compartments to an opposed blank may be provided in the form of pressure sensitive adhesive D. Substantially rectangular insert means E of substantially the same depth as the compartments are receivable within the compartments. Each of the insert means comprise a vertical tubular support F at each corner thereof offering vertical and horizontal support at each corner of the pallet as well as spaced supports at intermediate portions of the pallet.

Referring more particularly to FIGS. 1 through 12, it will be noted that a pair of opposed rectangular blanks A and B are folded preferably at opposite ends to produce inwardly facing compartments C. It will be noted that the Blanks A and B have a first score 10 adjacent an opposite end of each blank. A next transverse score 11 is provided at opposite ends of respective blanks to provide an end wall 12 for forming respective compartments C. Another transverse score 13 is provided together with a spaced transverse score 14 for forming an opposite inner wall 15. Respective flats 16 are defined by scores 17. Each of the flats carry opposed pressure sensitive adhesive areas 18 for forming the compartments C. It will be observed that pressure sensitive adhesive areas may be also provided opposite each of the compartments as illustrated at D.

Figure 2:
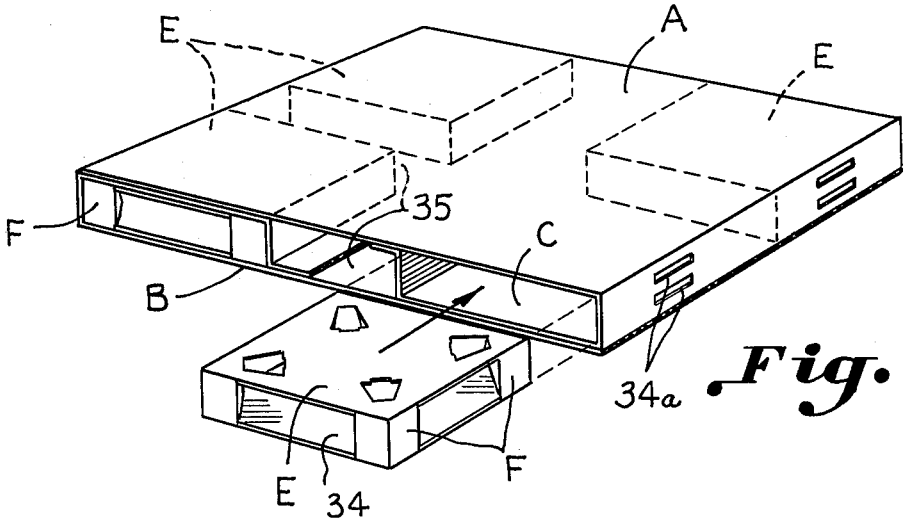
FIG. 2 is a perspective view similar to FIG. 1 illustrating the use of substantially rectangular insert means constructed in accordance with the present invention at each corner of the pallet assembly.

FIG. 2 illustrates the stage in the construction of the pallet wherein the adhesive areas D have been utilized to join the pair of opposed blanks with the compartments C in position to receive rectangular insert means E. As will be noted below, the rectangular insert means E each carries a plurality of spaced vertical tubular supports F, preferably one such support being at each corner of the insert.

Figure 4:
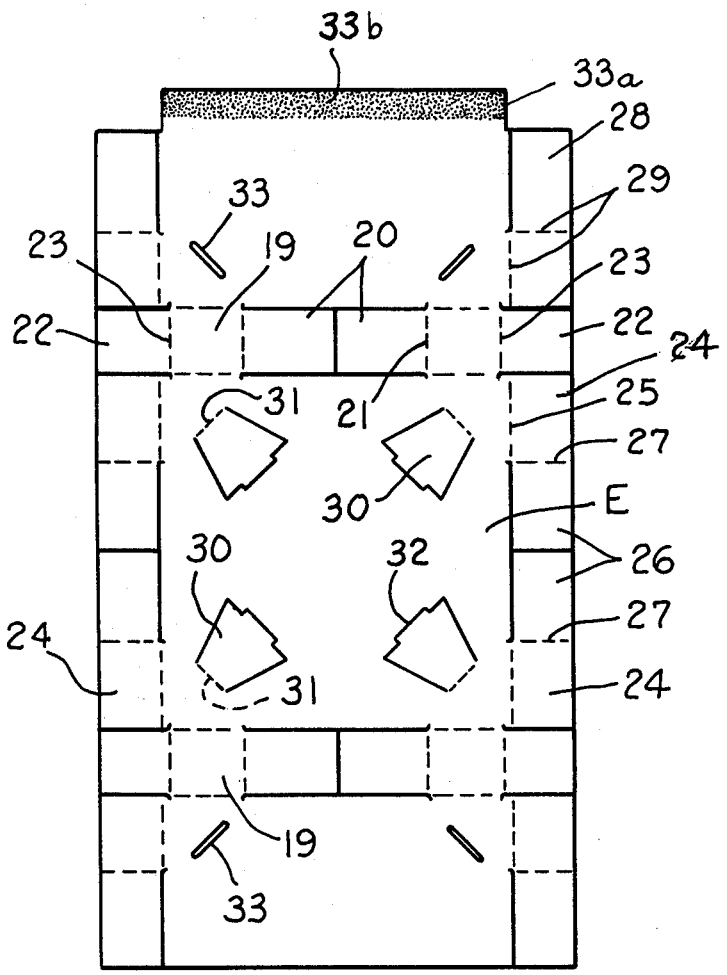
FIG. 4 is a plan view illustrating a scored blank for forming an insert in accordance with the invention.

FIG. 4 illustrates a blank which has been die cut preparatory to forming an insert means E. The insert means is formed from a substantially rectangular blank provided with suitable scores and cuts to be of substantially rectangular configuration providing a tubular support at each corner. The blank is scored to form sides 19 which are slit scored to provide tabs 20 which are foldable along opposed scores 21 inwardly whereas terminal tabs 22 are carried by scores 23. It will be observed that walls 24 are carried by marginal portions of the blank, by scores 25, forming the insert means E. Inwardly foldable tabs 26 are carried by each of the walls 24 and hinged at the scored lines 27. Tabs 28 are formed at each corner as by slitting and being hinged by scores 29. Inwardly converging tabs 30 are carried adjacent each corner of the retangular insert means converging toward the center and being hinged along respective score lines 31. Each of the tabs diverge toward a free edge carrying an end portion 32 defined by corner notches for reception within the diagonal cut-outs 33. A flat tab portion **33*a* formed in the blank, extending outwardly at one end of the blank between walls 19, may be provided with pressure sensitive adhesive as illustrated at 33*b***.

Figure 5:
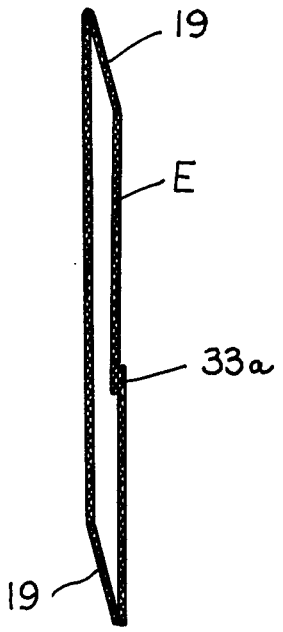
FIG. 5 is a transverse sectional elevation illustrating the initial fold of the blank illustrated in FIG. 4.
Figure 6:
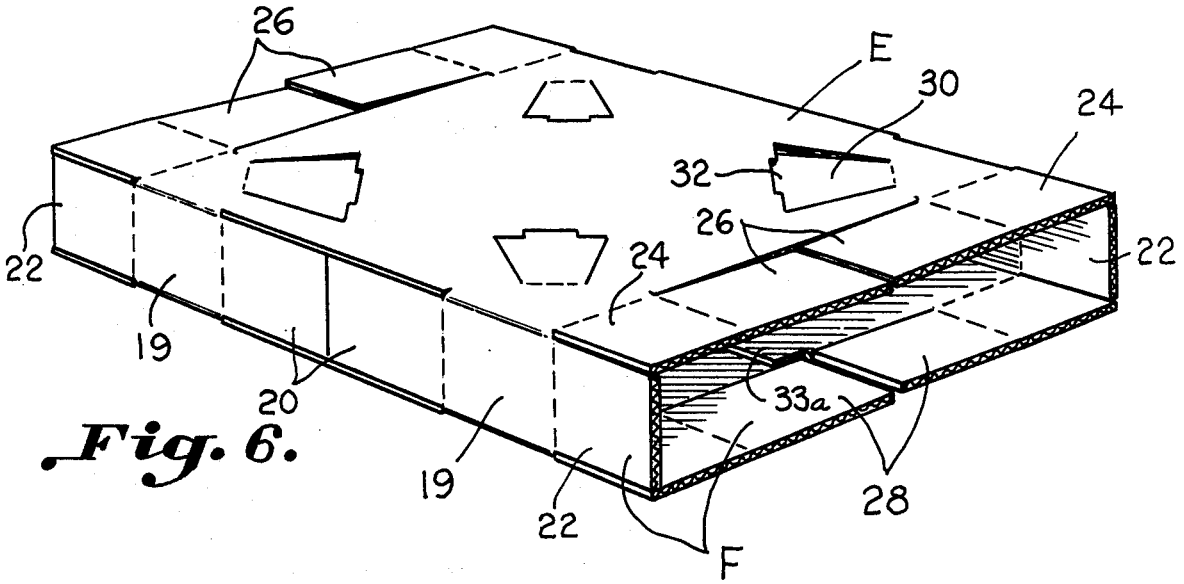
FIG. 6 is a perspective view illustrating the blank after initial folding commenced in FIG. 5.
Figure 7:
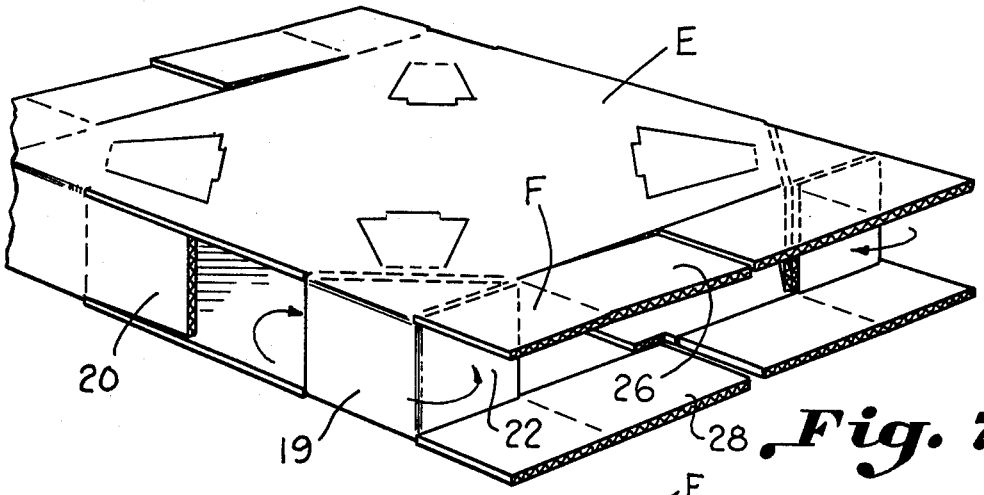
FIG. 7 is a perspective view illustrating a subsequent step in the assembly of the rectangular insert means wherein tabs which are hinged at score lines are folded inwardly as a further step of assembly.

FIG. 5 illustrates the first step in forming a rectangular insert wherein the pressure sensitive strip **33*a* is pressed adjacent an opposite end of the blank. The sides 19 may be raised and aligned to supporting position as illustrated in FIG. 6. The tabs 20 are folded inwardly as shown in broken line position in FIG. 7 as are the tabs 22**.

Figure 8:
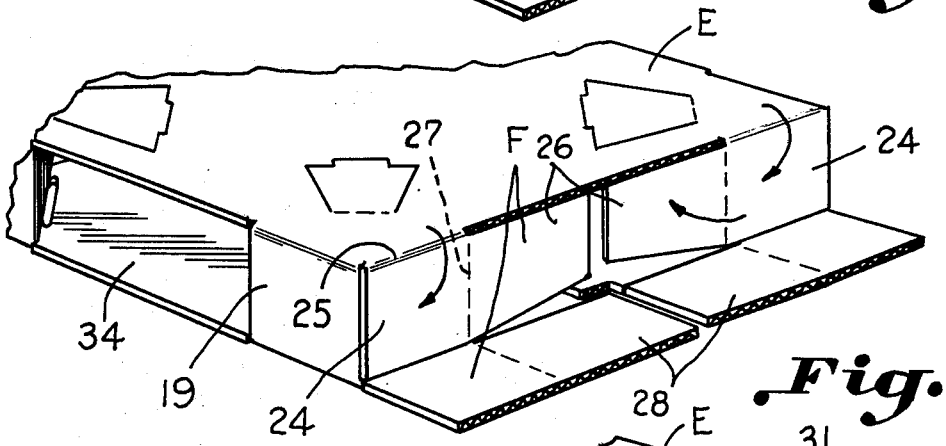
FIG. 8 is a perspective view illustrating a further folding operation wherein tabs are folded downwardly and inwardly.
Figure 9:
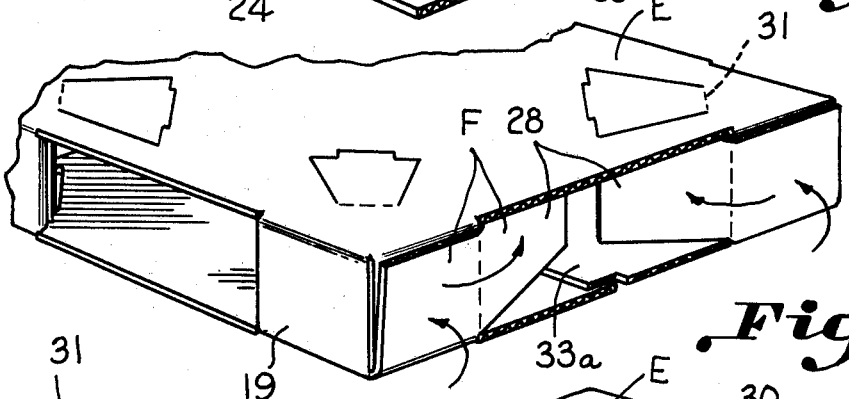
FIG. 9 is a perspective view illustrating a subsequent assembly step wherein tabs are folded upwardly and inwardly preparatory to completion of the formation of a tubular support adjacent each corner of the insert.

FIG. 8 illustrates the step of downwardly folding the tabs 26 which are hinged along the scores 27. The tabs 26 are then folded inwardly preparatory to similar folding of the opposite tabs 28, as illustrated in FIG. 9.

Figure 10:
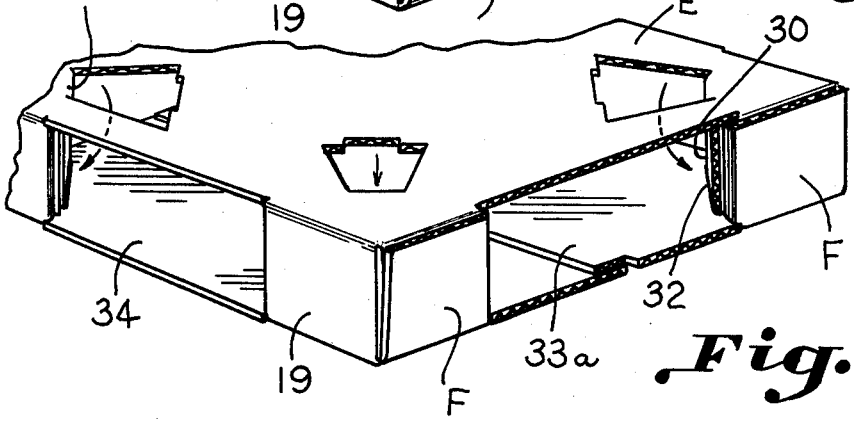
FIG. 10 is a perspective view illustrating a final step including the positioning of locking tabs in the formation of rectangular insert means to be carried adjacent each corner of the pallet of FIGS. 1, 2 and 3.
Figure 11:
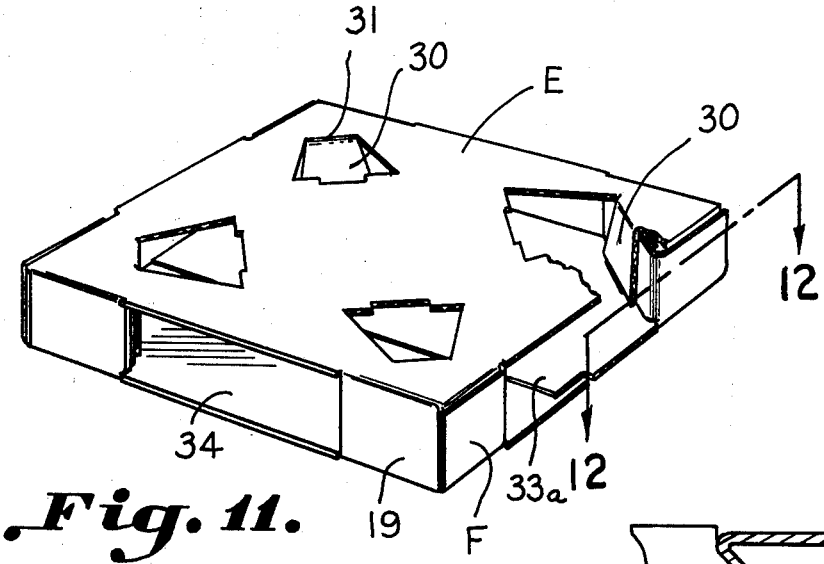
FIG. 11 is a perspective view illustrating a completed insert having been constructed according to the sequence heretofore illustrated.
Figure 12:
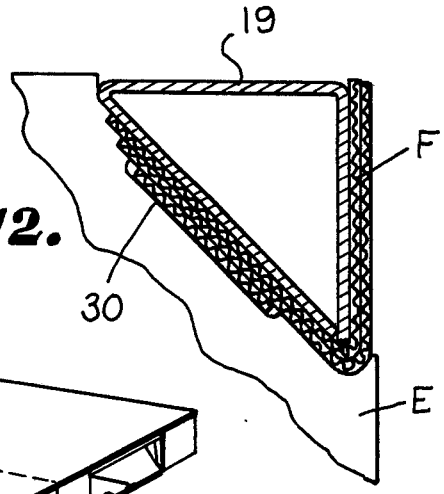
FIG. 12 is a sectional plan view taken on the line 12—12 in FIG. 11 illustrating a tubular support carried at each corner of an insert.

FIG. 10 illustrates folding the tabs 30 inwardly along the scored hinge portions 31 so that the portions 32 may be locked within the diagonal cut-out portions 33 thus completing the assembly of the inserts E. Thus, the inserts E define a tubular support F at each corner thereof.

Figure 3:
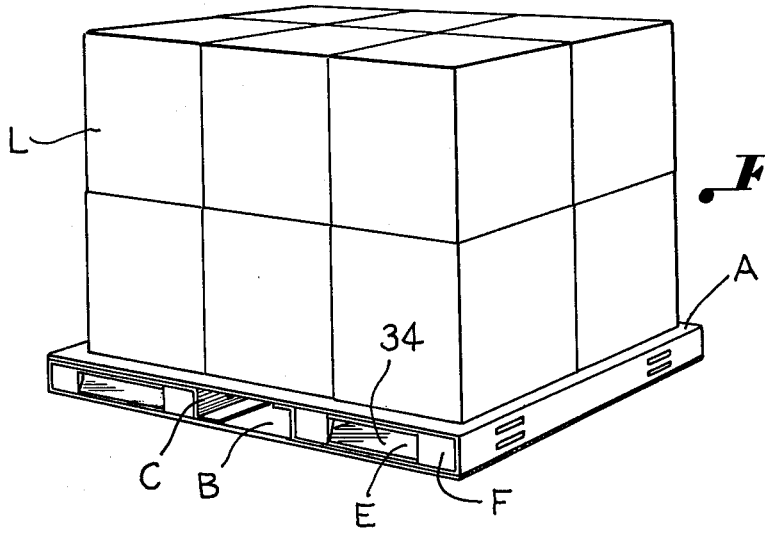
FIG. 3 is a perspective view illustrating the fully assembled pallet which has been fully loaded.

It will be observed that the vertical portions, folded as outlined above, forming the tubular posts or supports F at each corner of the insert serve a dual function in that they also provide openings as illustrated at 34 to accommodate the fork of a fork lift truck. It will be observed that each of the rectangular inserts E are preferably spaced both longitudinally and transversely as illustrated at 35 in FIG. 2. Perforations **34*a* are illustrated in the wall 12 which may be readily broken for reception within the underlying opening 34 to accommodate a fork lift truck for handling a load L such as shown in FIG. 3**.

Figure 13:
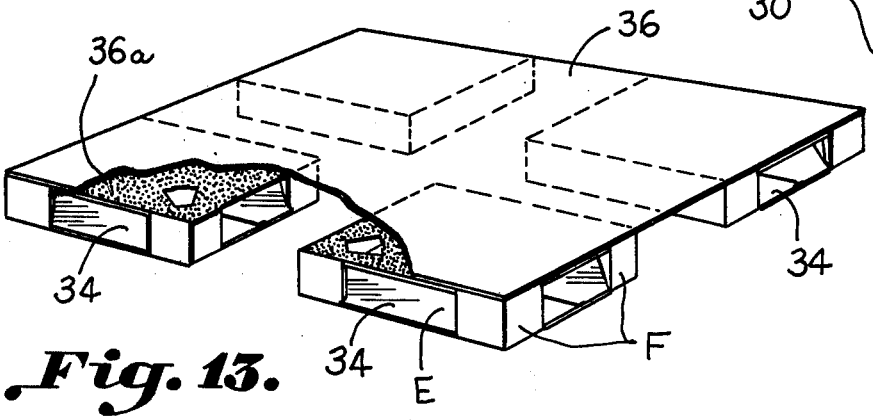
FIG. 13 is a perspective view illustrating a modified form of the invention.
Figure 14:
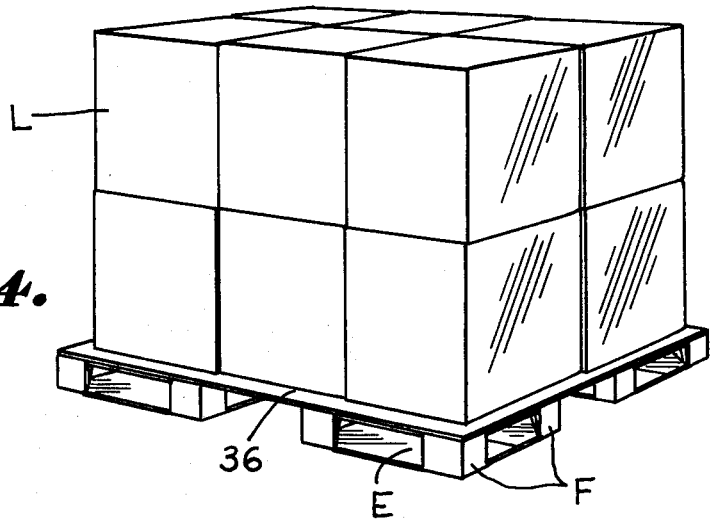
FIG. 14 is a perspective view further illustrating the modified form of the invention.

A modified form of the invention is illustrated in FIGS. 13 and 14 wherein rectangular insert means E, such as described above, are utilized adjacent each corner of a cardboard blank 36. The insert means E is illustrated as having a layer of pressure sensitive adhesive **36*a* across its flat upper surface for attachment to the lower surface of the blank 36**. It may be advantageous to use such a structure wherein the loads L are bulky but relatively light.

A further modified form of the invention is illustrated in FIGS. 15–19 wherein a modified form of the rectangular insert E is illustrated. A substantially rectangular blank preferably of double thickness fluted cardboard has transverse slit scores 37 defining marginal flaps **37*a* which may be folded inwardly for shipment as illustrated in FIG. 15 and then folded outwardly as illustrated in FIG. 16. Indentations 38 are provided at each corner to receive tubular paper board posts as illustrated at 39 in FIG. 17. If desired, the post may be of reduced size as illustrated at 40 depending on strength requirements desirable for the pallet to meet load and handling conditions. The indentations 38 are provided for receiving the tubular post 39 and the entire assembly is illustrated in FIG. 19**.

While a preferred embodiment of the invention has been described using specific terms, such description is for illustrative purposes only, and it is to be understood that changes and variations may be made without departing from the spirit or scope of the following claims.

What is claimed is:

1. A foldable fork lift pallet comprising:

a pair of opposed substantially rectangular superposed cardboard blanks;

a plurality of spaced transverse scores in each of said blanks;

elongated transverse inwardly facing spaced compartments of substantially rectangular cross-section adjacent an opposite end of each of said blanks formed by folding said blanks along said scores and securing said blanks in folded position;

means for securing each of said compartments to an opposed blank forming said pallet;

substantially rectangular insert means of substantially the same depth as said compartments receivable within said compartments;

said insert means including a substantially rectangular cardboard blank;

opposed end walls defined by spaced pairs of transverse scores in said blank;

each of said end walls being spaced inwardly of opposed edges of said blank defining top flaps when said blank is folded along said scores;

opposed side walls defined by a plurality of longitudinal scores adjacent each edge of said blank;

a pair of inwardly foldable vertical flaps hinged at opposed ends thereof adjacent spaced intermediate portions of at least one of said walls; and said flaps when folded inwardly forming a triangular tubular core at each corner of said insert means and fork lift openings therebetween.

2. The structure set forth in claim 1 including hinged tabs depressibly carried in said blank between said walls adjacent said flaps for locking said flaps in supporting position in said insert means.

3. The structure set forth in claim 1 wherein said insert means are transversely spaced within said compartments, and said compartments are longitudinally spaced on said blank.

4. A fork lift pallet comprising:

a load carrying and positioning member comprising a substantially rectangular blank;

a substantially rectangular support means positionable at each corner of said load carrying and positioning member forming said pallet;

each of said support means including a substantially rectangular blank;

opposed end walls defined by spaced pairs of transverse scores in said blank;

each of said end walls being spaced inwardly of opposed edges of said blank defining top flaps when said blank is folded along said scores;

opposed side walls defined by a plurality of longitudinal scores adjacent each edge of said blank;

a pair of inwardly foldable vertical flaps hinged at opposed ends thereof adjacent spaced intermediate portions of at least one of said walls; and said flaps when folded inwardly forming a triangular tubular core at each corner of said support means and fork lift openings therebetween.

5. A support member for a fork lift pallet comprising:

a substantially rectangular cardboard blank;

opposed end walls defined by spaced pairs of transverse scores in said blank;

each of said end walls being spaced inwardly of opposed edges of said blank defining top flaps when said blank is folded along said scores;

opposed side walls defined by a plurality of longitudinal scores adjacent each edge of said blank;

a pair of inwardly foldable vertical flaps hinged at opposed ends thereof adjacent spaced intermediate portions of at least one of said walls; and said flaps when folded inwardly forming a triangular tubular core at each corner of said support member and fork lift openings therebetween.

6. The structure set forth in claim 5 including depressible tabs carried in said blank between said pairs of transverse scores for locking said flaps in position across each respective corner of said support member defining entry openings for the forks of a fork lift truck.

* * * * *